US005079889A

United States Patent [19]

Wright

[11] Patent Number: 5,079,889

[45] Date of Patent: Jan. 14, 1992

[54] ROOF TILE FIXING CLIP

[75] Inventor: Norman Wright, Tunbridge Wells, England

[73] Assignee: Marley Tile AG, Switzerland

[21] Appl. No.: 452,310

[22] Filed: Dec. 19, 1989

[30] Foreign Application Priority Data

Dec. 19, 1988 [GB] United Kingdom ..... 8829600

[51] Int. Cl.[5] ..... E04D 1/34

[52] U.S. Cl. ..... 52/547; 52/548

[58] Field of Search ..... 52/547, 548, 549, 521

[56] References Cited

U.S. PATENT DOCUMENTS

| | | | |
|---|---|---|---|
| 757,285 | 4/1904 | Duchemin | 52/547 |
| 1,579,715 | 4/1926 | Kridler et al. | 52/548 |

FOREIGN PATENT DOCUMENTS

| | | | |
|---|---|---|---|
| 495578 | 12/1975 | Australia | 52/548 |
| 48626/79 | 11/1979 | Australia . | |
| 13818 | of 1913 | United Kingdom . | |
| 308428 | 3/1929 | United Kingdom . | |
| 1174891 | 12/1969 | United Kingdom . | |
| 2101172 | 1/1983 | United Kingdom . | |

OTHER PUBLICATIONS

Cathiers Du Centre, Scientifique et Technique du Batiment, Jan. 1949.

*Primary Examiner*—Richard E. Chilcot, Jr.
*Attorney, Agent, or Firm*—Bacon & Thomas

[57] ABSTRACT

A tile clip for a pitched roof of laterally interlocked tiles is provided for restraining a tile against movement away from, and movement down, the roof. The clip is secured to a roof batten adjacent the lower end of the tile, on which batten rest tiles in a row below the row containing the tile, being overlapped by the said tile. The clip comprises first, second and third portions; the first portion being securable to the batten, without removing the tiles resting thereon, and extending up to the end of such tiles; the second portion extending from the first portion to the upper surface of the tiles resting on the batten; and the third portion extending from the second portion down the tiles resting on the batten along the join between the said tile in the row above and a tile laterally adjacent thereto, to the lower end of said tile. The third portion terminates in a book portion which extends laterally and upwardly therefrom so as to hook over the lower end of the said tile and extend into the interlocking region of the said tile and the laterally adjacent tile.

7 Claims, 3 Drawing Sheets

ROOF TILE FIXING CLIP

This invention relates to a clip for fixing a roof tile on a pitched roof. The clip is of particular use in the fixing of a replacement tile in a system where the tiles have interlocking regions along their lateral edges. Typically, an interlocking region of one tile overlaps an interlocking region of an adjacent tile and a ridge extending along one interlocking region engages in a channel extending along the other.

A pitched roof using such interlocking tiles conventionally comprises rows of laterally interlocked tiles, with the rows overlapping down the roof. Particularly in the case of profiled tiles, having e.g. an undulating appearance, the joins between adjacent tiles will be aligned in the various rows up the roof. Each tile normally has a transverse rib on its underside adjacent its upper end, which engages over a batten on the roof. It is known to use a clip to hold the lower end of a tile down, and in so doing to keep down the upper end of the tile in the next row down the roof. Such a clip can be secured to a roof batten in a suitable manner, and can engage in the interlocking channel of the upper tile. Such an arrangement is shown in e.g. GB 1,174,891 and GB 2,101,172.

When it becomes necessary to replace a tile which is damaged, it is desirable to be able to do so without disturbing adjacent tiles excessively. Removal of the broken tile can be achieved by smashing it into easily manageable pieces for removal but insertion of the replacement tiles can present difficulties. Removal of the nib on the underside of the tile enables it to be positioned correctly, without having to lift the tile in the row above excessively, which would otherwise be necessary to enable the nib to be engaged over the batten. However, the replacement tile will be free to slide down the roof.

Another problem is that clips used to locate tiles can be unsightly and detract from the appearance of a roof. A further problem is that some clips have portions that underlie a tile in such a way that their size must be restricted or the laying of the tiles will be disturbed. For example, the clip in GB-1174891 has a portion which lies on the upper surface of the batten, on which the tiles rest. This limits the diameter of the wire from which the clip is made, if it is not to interfere unduly with the laying of the tiles in an even fashion.

According to the invention, a tile clip for a pitched roof of laterally interlocked tiles is provided for restraining a tile against movement away from, and movement down, the roof, the clip being secured to a roof batten adjacent the lower end of the said tile, on which batten rest tiles in a row below the row containing the tile, being overlapped by the said tile; wherein the clip comprises first, second and third portions; the first portion being securable to the batten, without removing the tiles resting thereon, and extending up to the end of such tiles; the second portion extending from the first portion to the upper surface of the tiles resting on the batten; and the third portion extending from the second portion down the tiles resting on the batten along the join between the said tile in the row above and a tile laterally adjacent thereto, to the lower end of said tile; and wherein the third portion terminates in a hook portion which extends laterally and upwardly therefrom so as to hook over the lower end of the said tile and extend into the interlocking region of said tile and the laterally adjacent tile.

In this manner, the tile is held in place but the only part of the clip visible is the part of the hook extending over the end of the tile. The rest of the hook is concealed in the interlocking region. The clip portion extending down the roof underneath the tile to be fixed, extends along the join between that tile and the adjacent tile. This front join region conventionally is open somewhat along the undersurface of the tiles. This means that the clip can be made of wire or the like of relatively large diameter without disturbing the even laying of the tiles; the wire can be wholly or partially received in the gap along the join.

The portion to be secured to the batten can simply have an end sharpened or otherwise adapted to be driven into the batten by hammering or the like. Normally, easy access to the batten will be impeded by the nibs of the tiles but this will not be the case in the region of the join between tiles. Thus, in a roof where the joins of adjacent rows are aligned, the clip will generally have the first, second and third portions all lying in a plane containing a line of joins extending up the roof. Thus, these three portions will form a "U" shape although the third portion will generally be longer than the first portion.

The hook can comprise a first part which extends perpendicularly to the axis of the third portion but at an angle to the plane of the three portions, and a second part which extends parallel the said plane. The angle can be, say, 45 degrees.

The clip can be made from suitably stout steel wire or the like, to withstand being hammered into the batten and to restrain the tile in the event of strong winds.

The clip is of particular use in the securing of a replacement tile which does not have a nib at its upper end but it will be of use in other contexts.

The invention extends also to a pitched roof having interlocked tiles, at least one of which is secured by a clip as above described.

An embodiment of the invention will now be described by way of example and with reference to the accompanying drawings, in which.

Figure 1:
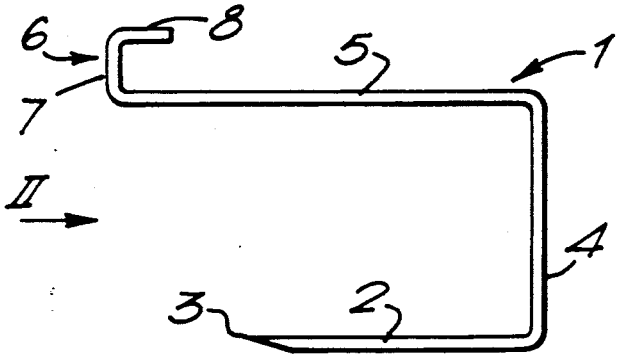
FIG. 1 is a side view of a clip.
Figure 2:
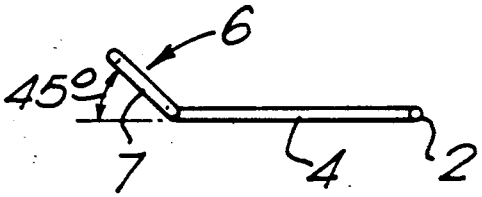
FIG. 2 is a end view in the direction II on FIG. 1.

As shown in FIG. 1, the clip 1 is of generally "U" shaped configuration and is bent from suitable steel wire. It has a first portion 2 with a pointed end 3 adapted to be driven into a wooden tiling batten; a second portion 4 at right angles to portion 2; and a third portion 5 is parallel to portion 2 which is slightly longer than portion 2. These three portions lie in the same plane. At the end of third portion 5 is a hook portion 6 which has a part 7 extending away from the plane of portions 2, 4, and 5 at an angle of 45°, as can be seen from FIG. 2, and a part 8 extending back parallel to portions 2 and 5.

Figure 3:
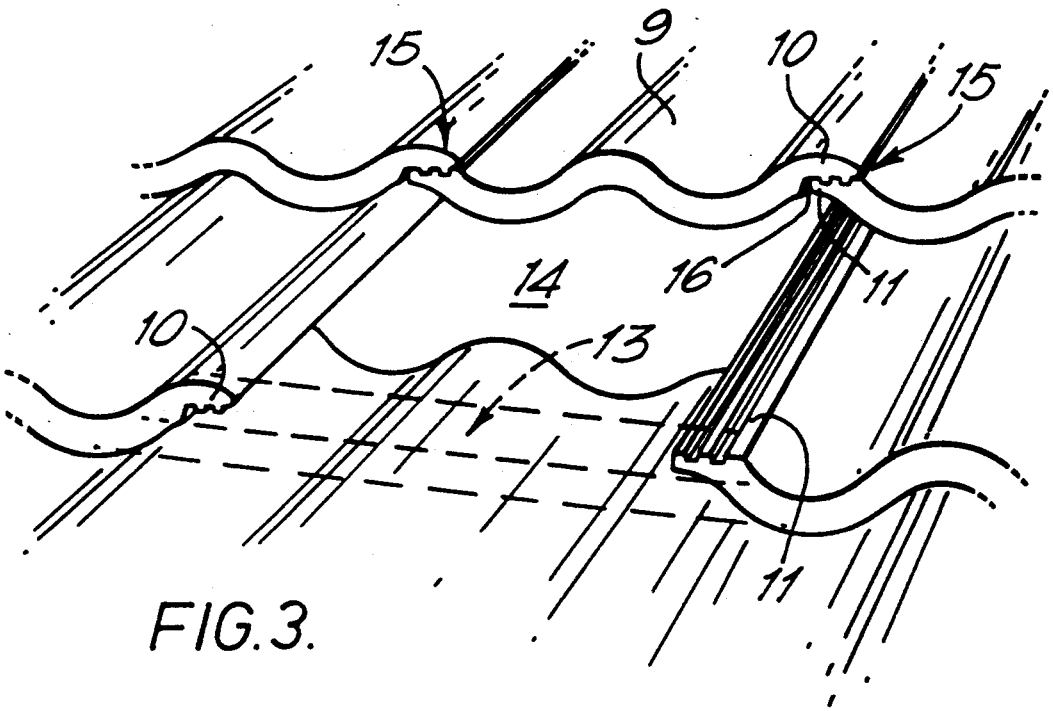
FIG. 3 is a view of a roof with a tile removed, to be replaced.

In FIG. 3 there is shown a roof of tiles 9 which have an undulating profile. These are laid in rows, with each row overlapping the row below. The tiles 9 in a row are interlocked along their edges, by means of an upper interlocking portion 10 having ridges and channels engaging with a lower interlocking portion 11, having corresponding ridges and channels, each tile 9 having an upper interlocking portion 10 along one edge and a lower interlocking portion 11 along the other edge. Each tile has a conventional nib 12 on its underside (not shown) which engages over a tiling batten as indicated diagrammatically by broken lines at 13. Conventional clips can be used to restrain the tiles 9. A replacement tile to occupy the space marked as 14 must interlock with the tiles on either side and must lie under the tile in the row above. It will be seen that the tiles are aligned, so that the join 15 between two adjacent tiles in one row is aligned with the join in the rows above and below. As can be seen in FIG. 3, the design of the tiles is such that where two adjacent tiles are joined, as at 15, a space or groove 16 is defined along the underside of the tiles.

Figure 4:
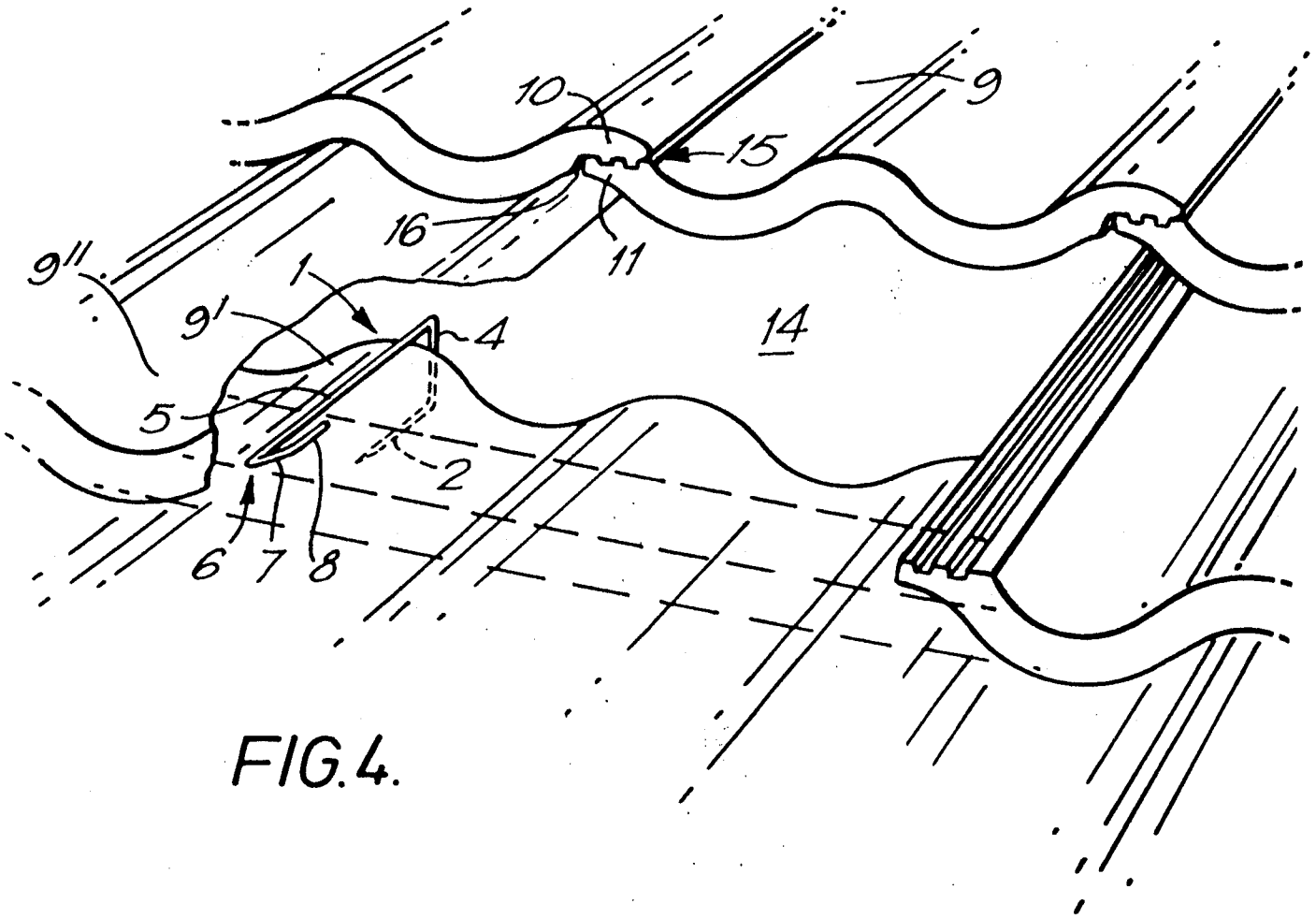
FIG. 4 shows the clip positioned ready to receive the replacement tile.
Figure 5:
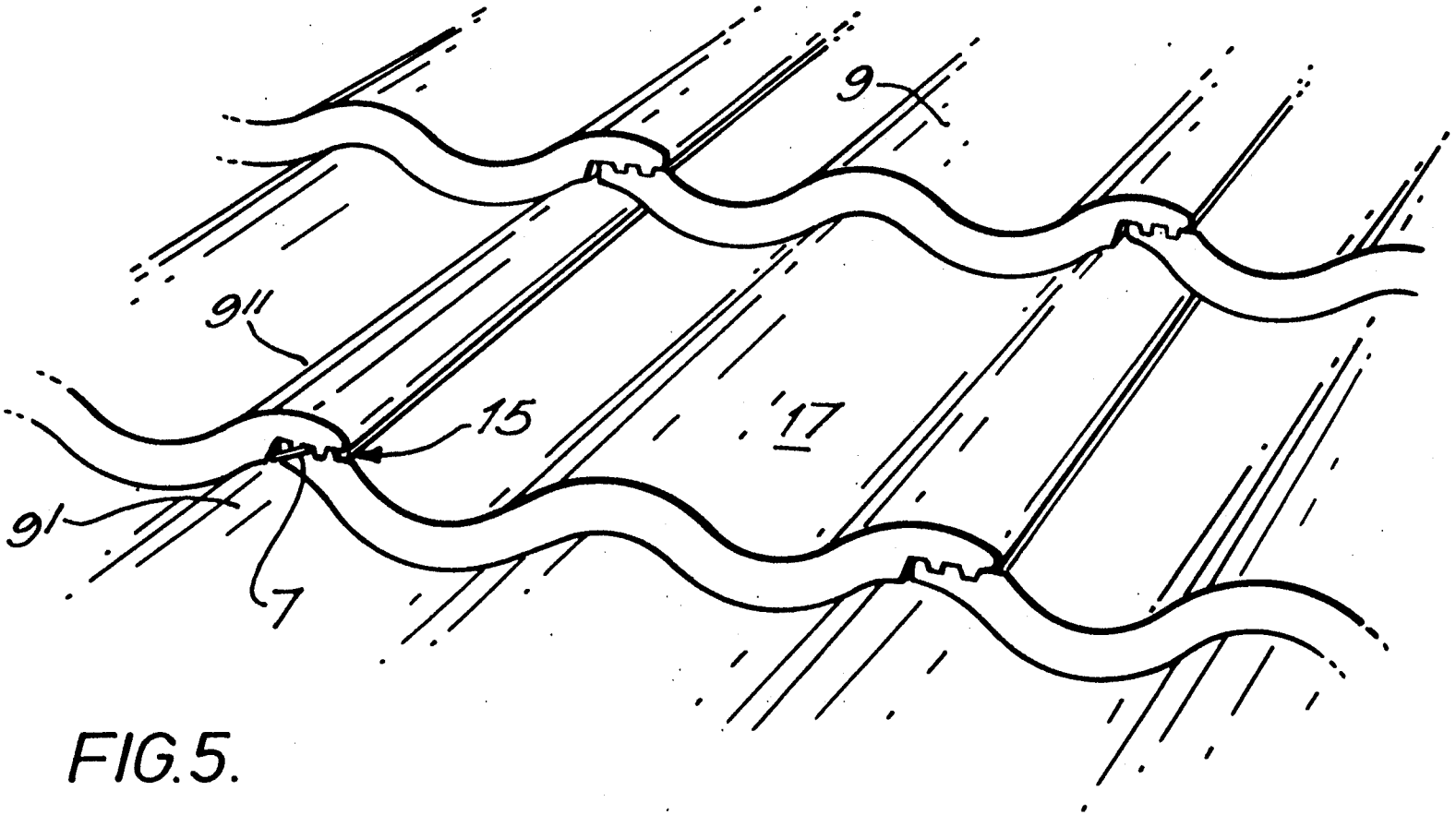
FIG. 5 shows the roof with the replacement tile.

The replacement tile to occupy space 16 will have no nib, so that it will not unduly disturb the tile in the overlapping row above; It must be held against sliding down the roof, and against movement away from the roof. This is done by means of the clip 1. As shown in FIG. 4, the clip 1 is hammered into the roof batten in the region of the join 15 between the tiles. Portion 5 extends along the top of a tile 9' in the row below the space 14, along the line of the groove 16 that will be formed at the join between the tile 9'' to the left of the space 14, and the replacement tile to be pushed into space 15. The clip is driven into the batten so that the end of portion 5 is at the overlap position. The hook portion 6 at the end of portion 5 is inclined upwardly so that the part 8 will engage in the interlocked regions of tile 9'' and the replacement tile. FIG. 5 shows a replacement tile 17 in place. As can be seen, only the small part 7 of clip 1 is visible. This part restrains the tile 17 from sliding down the roof, whilst part 8 holds the tile 17 down. Thus, there is provided a system for locating a replacement tile which gives reliable fixing but which ensures that the replacement tile and adjacent tiles can be as originally laid, without undue disturbance of the adjacent tiles.

Variations in the specific design of the clip and the manner of use, may be possible.

I claim:

1. A pitched roof comprising a plurality of lateral roof battens and respective rows of laterally interlocked tiles engaging said battens, the tiles in one said row overlapping the tiles in a row adjacent said one row in a direction down the roof, at least one tile being secured by means of a tile clip, said tile clip comprising: a first portion having means for engaging a batten adjacent and in a direction down the roof relative to the batten engaged by said at least one tile, said first portion extending in a direction up the roof to a point proximate an upper end of a tile overlapped by said at least one tile; a second portion extending from the first portion to a point proximate the upper surface of the overlapped tile; and a third portion extending from the second portion down the roof between said at least one tile and a laterally adjacent tile, said third portion terminating in a hook portion which extends laterally and upwardly therefrom and which hooks over a lower end of said at least one tile and extends into an interlocking region of said at least one tile and said laterally adjacent tile.

2. A roof according to claim 1 wherein the first, second and third portions all lie in a single plane and form a generally U-shape, said third portion being longer than said first portion.

3. A roof according to claim 2 wherein said hook portion comprises a first part that extends perpendicularly to the axis of the third portion but at an angle to the plane containing the first, second and third portions, and a second part which extends parallel to the said plane.

4. A roof according to claim 3 wherein said angle is 45°.

5. A tile clip comprising first, second and third portions lying in a single plane and forming a generally U-shape, said first portion including means for engaging a roof batten, and said third portion terminating in hook means, said hook means extending laterally and upwardly from said third portion and comprising a first part that extends perpendicularly to the axis of the third portion but at an angle to the plane containing the first, second and third portions, and a second part which extends parallel to the said plane.

6. A tile clip according to claim 5 wherein said third portion is longer than said first portion.

7. A tile clip according to claim 5 or 6 wherein said angle is 45°.

* * * * *